US008536454B2

(12) United States Patent
Wang et al.

(10) Patent No.: US 8,536,454 B2
(45) Date of Patent: Sep. 17, 2013

(54) HOUSING SYSTEM FOR RECEPTACLES

(75) Inventors: Mingchang Wang, Shanghai (CN); Qingqiang Guo, Shanghai (CN)

(73) Assignee: EMC Corporation, Hopkinton, MA (US)

( * ) Notice: Subject to any disclaimer, the term of this patent is extended or adjusted under 35 U.S.C. 154(b) by 112 days.

(21) Appl. No.: 13/105,544

(22) Filed: May 11, 2011

(65) Prior Publication Data

US 2012/0168223 A1 Jul. 5, 2012

(30) Foreign Application Priority Data

Dec. 30, 2010 (CN) ..... 2010 1 0612937

(51) Int. Cl.
*H01H 9/02* (2006.01)

(52) U.S. Cl.
USPC ..... 174/53; 174/57; 439/107; 220/3.7

(58) Field of Classification Search
USPC ..... 174/53, 57; 439/107, 501, 142; 220/3.3, 3.7
See application file for complete search history.

(56) References Cited

U.S. PATENT DOCUMENTS

| | | | | |
|---|---|---|---|---|
| 5,839,908 | A * | 11/1998 | Bonilla et al. | 439/107 |
| 7,897,869 | B2 * | 3/2011 | St. Clair | 174/53 |
| 7,915,528 | B2 * | 3/2011 | Ni | 174/53 |
| 8,022,298 | B2 * | 9/2011 | Husain et al. | 174/53 |

* cited by examiner

*Primary Examiner* — Dhirubhai R Patel
(74) *Attorney, Agent, or Firm* — Krishnendu Gupta; Konrad R. Lee

(57) ABSTRACT

A housing system for covering a receptacle mounted on a board includes a base, a first flap and a second flap. Each of the first and second flaps has a proximal end, a distal end and an intermediate portion between the proximal and distal ends. Each of the first and second flaps is mounted to the first and second opposing walls of the base such that each of the first and second flaps pivotally moves about a connection point with each of the first and second opposing sidewalls at the proximal end of each of the first and second flaps, between a first position and a second position. In the first position, the intermediate portions of each of the first and second flaps are a first distance from each other and the distal ends of the first and second flaps are a second distance from each other. The second distance is greater than the first distance.

20 Claims, 11 Drawing Sheets

HOUSING SYSTEM FOR RECEPTACLES

FIELD OF THE INVENTION

This invention relates generally to electrical receptacles and more particularly to a housing system for covering an electrical receptacle while not in use.

BACKGROUND

Large-scale storage systems typically include one or more cabinets housing a number of disk array enclosures, power supplies and electronics to enable the communication of data between a host and the disk drives in the disk array enclosures. In such systems, each disk array enclosure ("DAE") which houses a number of disk drives, is mounted within the cabinet to enable access to the disk drives of the enclosure from the front of the cabinet and access to components such as power supplies of the enclosure from the rear of the cabinet. The DAEs are mounted within the cabinet in a stacked configuration, which enables a large number of disk drives to be included in each cabinet.

A DAE may include a plurality of connectors for electrically coupling a plurality of disk drives to the DAE. For example, the DAE may include a plurality of Serial Attached Small Computer System Interface (SAS) connectors for electrically coupling a plurality of SAS disk drives to the DAE. SAS is a data transfer technology designed to move data between a computer and computer storage devices, such as hard disk drives. Each disk drive is inserted into a disk carrier. Each disk carrier may have a PCB paddle card acting as an interposer between the disk drive and a circuit board. The circuit board may be arranged in a plane substantially orthogonal to the plane of the plurality of disk carriers, wherein the circuit board provides electrical interconnections within the plurality of disk carriers, and from the circuit board to other portions of the storage system or vice versa.

As is known in the art, electrical connectors are often used in electrical components, such as disk drive units, to connect the drives to a printed circuit board ("PCB"). The electrical connecter generally includes dielectric housing having therein an array of electrical terminals extending through the housing. One end of the connector is configured to have inserted therein the disk drive unit, with electrical contacts of the unit making electrical contact with the electrical terminals. The terminals are adapted to be soldered to electrical contacts disposed on a surface of the PCB with the terminals extending perpendicularly outwardly from the surface of the PCB. Thus, the electrical connector has a base adapted to mount to the planar surface of the PCB with sidewalls of the PCB extending perpendicular to the surface of the PCB.

The coupling of these electrical components to the electrical connectors can raise a number of issues. In certain environments, pin contacts of the electrical connectors may rub or scrape against the contact pads of a SAS connector (also referred to as a SAS receptacle). This rubbing and scraping can degrade physical contact between the SAS receptacle and the electrical connectors, producing metal debris that can be deposited within the data storage system. Additionally, metal debris may also be generated by friction between disk carriers and disk drive units. Further, when disk drive units are arranged in a vertical configuration within a DAE, such that the SAS receptacles are mounted to horizontal PCBs and facing upwards, there is a risk of such metal debris falling into a SAS receptacle. When metal debris come in contact with the pins of the SAS receptacle, it may cause electrical shortening.

SUMMARY

A housing system for covering a receptacle mounted on a circuit board is disclosed, which provides protection for the receptacle from debris that may otherwise come into contact with the receptacle. The housing system includes a base with two flaps mounted thereto. The base has two opposing sidewalls that define an interior space there between. Each of the two flaps is mounted between the opposing walls of the base at a connection point with each of the opposing walls. Additionally, each of the two flaps pivotally move about the connection points between an open and a close position. In the open position, the housing system allows a paddle card of a disk drive to enter the interior space for connecting to the receptacle. In the closed position, both flaps cover the interior space and protect the receptacle from metal debris that may be generated in a disk array enclosure and may fall into the interior space. In the closed position, the flaps allow metal debris to fall through apertures in each of the flaps, thus preventing the debris from falling into the receptacle when the paddle card is inserted.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

These and other features will become more readily apparent from the following detailed description when read together with the accompanying drawings, in which.

DETAILED DESCRIPTION

Figure 1:
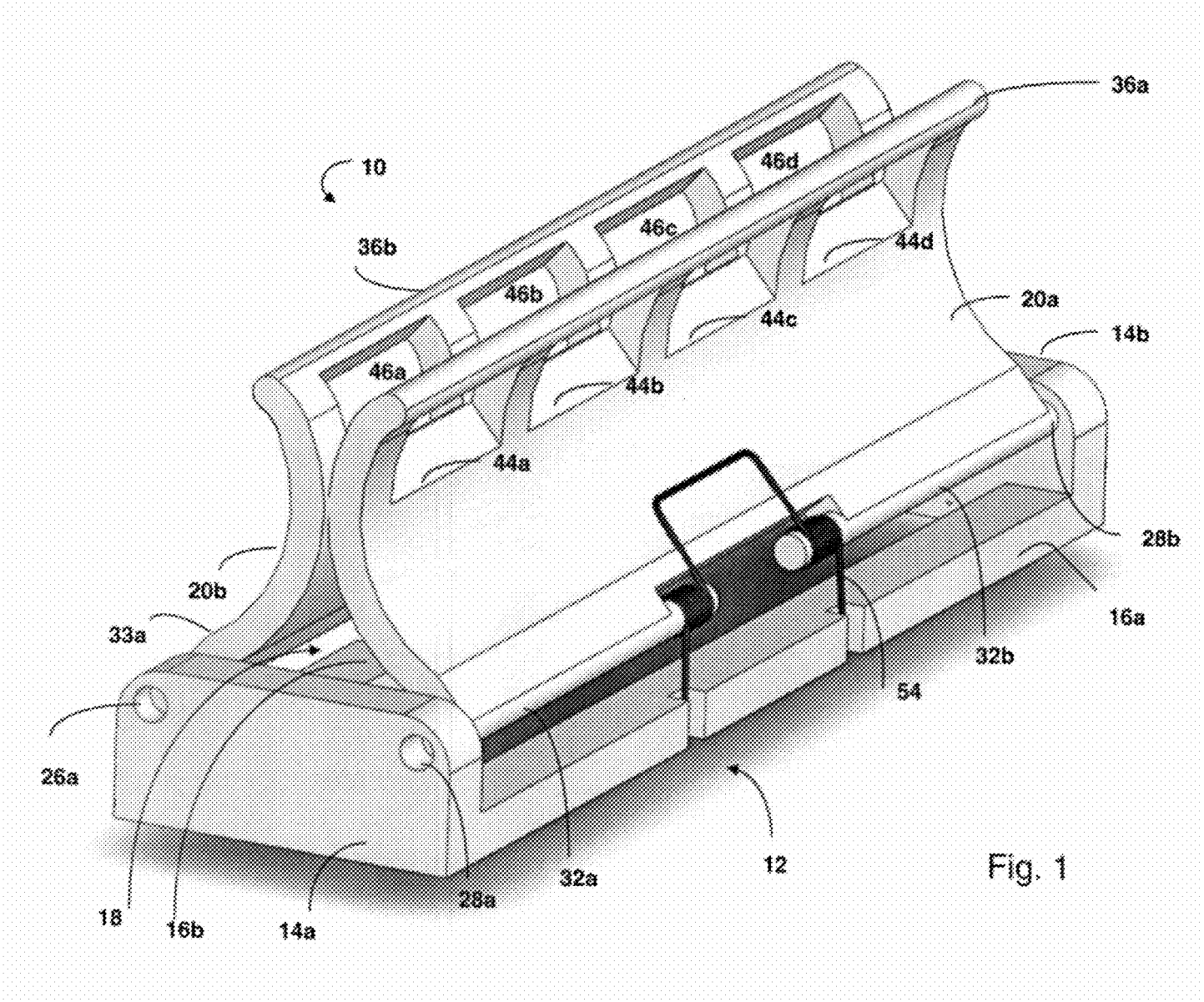
FIG. 1 is a perspective view of a housing system for an electrical receptacle in accordance with the present invention.
Figure 2B:
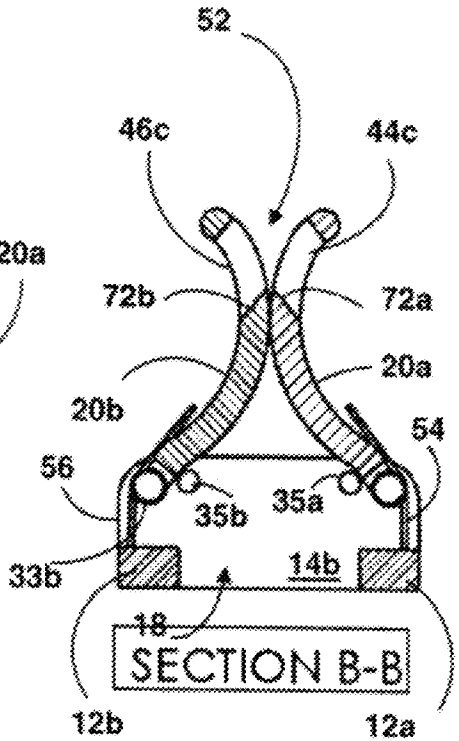
FIG. 2B is a cross-sectional view of the housing system.

FIG. 1 is a perspective view of a housing system 10 for an electrical receptacle or connector. Housing system 10 includes a base portion 12 having opposing side walls 14*a* and 14*b* mounted at each end of spaced longitudinal rails 16*a* and 16*b*, and a pair of flaps 20*a* and 20*b* mounted to the side walls 14*a* and 14*b*. In the embodiment shown in FIG. 1, flaps 20*a* and 20*b* are mounted to side walls 14*a* and 14*b* by a post-and-hole configuration. Specifically, flap 20*a* includes a post 32*a* which is rotatably mounted in hole 28*a* of sidewall 14*a* and a post 32*b* which is rotatably mounted in hole 28*b* of sidewall 14*b*. Likewise, flap 20*b* includes a post 33*a* which is rotatably mounted in hole 26*a* of sidewall 14*a* and a post 33*b* (FIG. 2B)

which is rotatably mounted in a hole (not shown) of sidewall 14*b*. A spring 54 is mounted between posts 32*a* and 32*b* of flap 20*a* and rail 16*a* of base 12, which, as further described below, biases flap 20*a* in a closed position. Likewise, a spring 56 (FIG. 2B) is mounted between posts 33*a* and 33*b* of flap 20*b* and rail 16*b* of base 12, which, as further described below, biases flap 20*b* in a closed position. Base portion 12 and flaps 20*a* and 20*b* may be formed from any dielectric material, such as plastic.

Flaps 20*a* and 20*b* further include a number of apertures along the upper portion thereof. Specifically, flap 20*a* includes apertures 44*a*, 44*b*, 44*c* and 44*d* between a midpoint of the flap and upper portion 36*a* and flap 20*b* includes apertures 46*a*, 46*b*, 46*c* and 46*d* between a midpoint of the flap and upper portion 36*b*.

Side walls 14*a* and 14*b*, longitudinal rails 16*a* and 16*b* and flaps 20*a* and 20*b* cooperate to define an interior space 18 for housing a connector or receptacle, as described in further detail below.

Figure 2A:
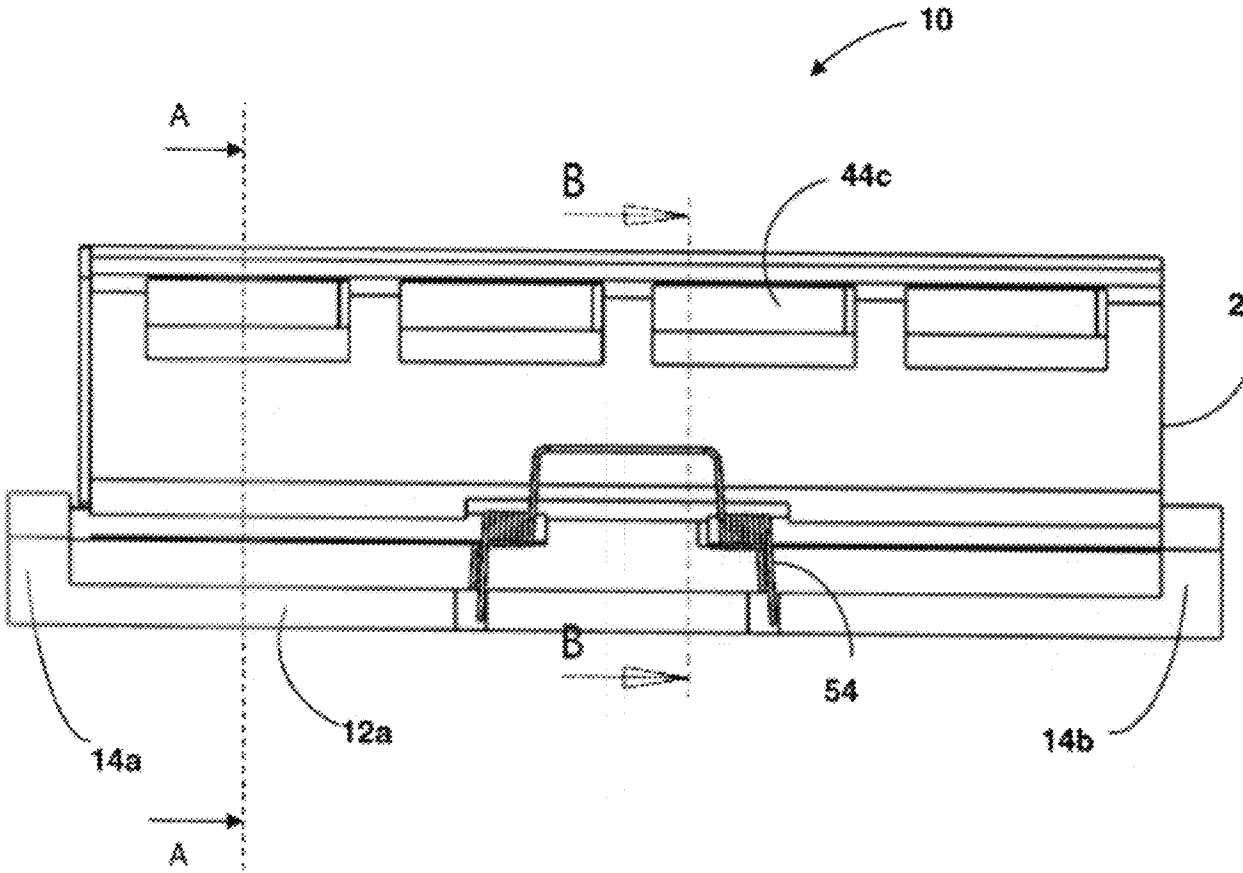
FIG. 2A is a side view of the housing system of FIG. 1.
Figure 2C:
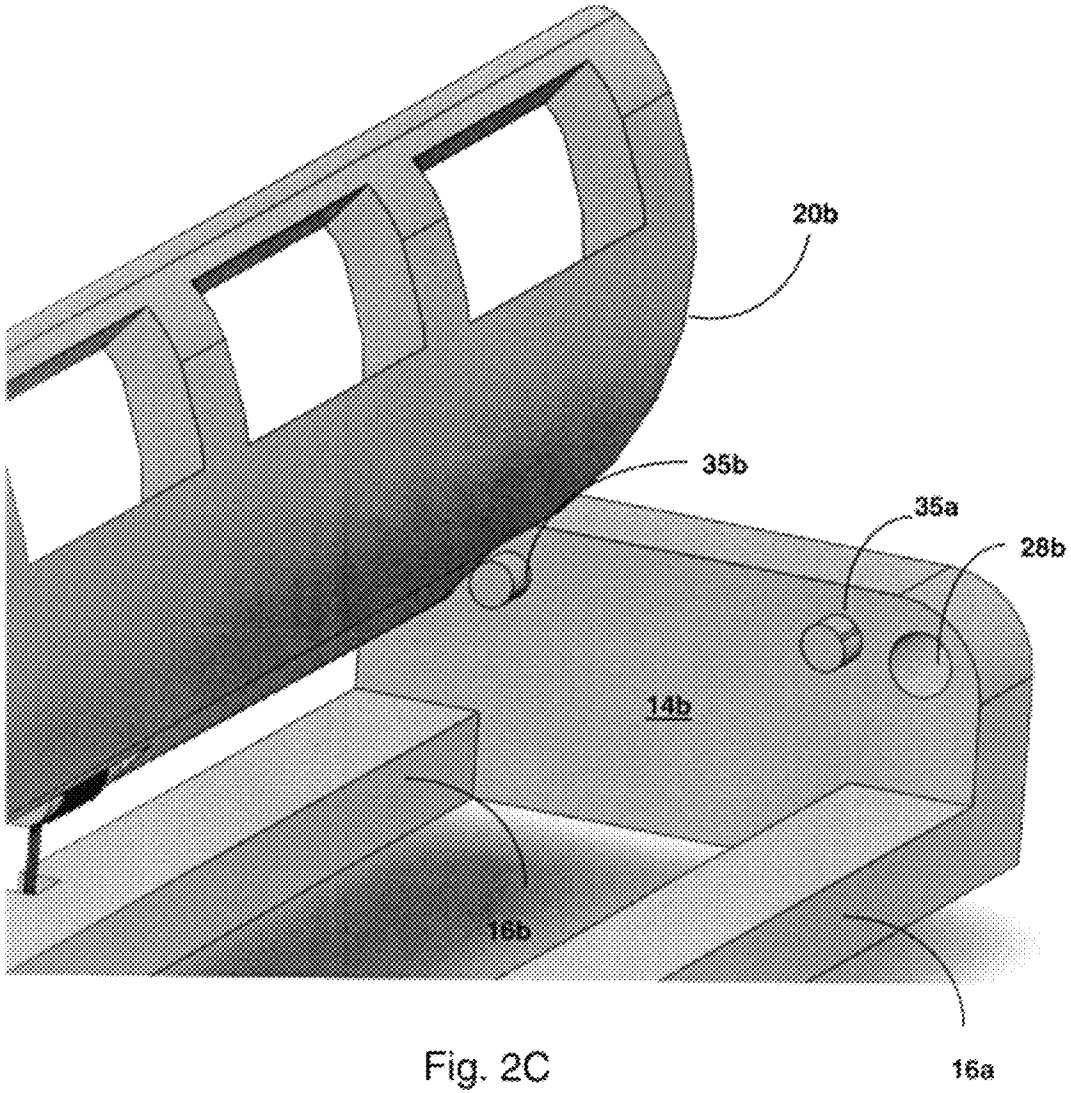
FIG. 2C is a partial perspective diagram of the housing system.

FIG. 2B is a cross-sectional diagram of housing 10, taken along lines B-B of FIG. 2A. As shown in FIG. 2B, in addition to post 33*b* and spring 56, stops 35*a* and 35*b*, which protrude inwardly from sidewall 14*b*, act to prevent flaps 20*a* and 20*b* from being biased beyond a center point of the housing 10. FIG. 2C, which is a partial perspective view of housing 12, shows stops 35*a* and 35*b* in greater detail. Although not shown, side wall 14*a* includes similar stops.

Figure 3:
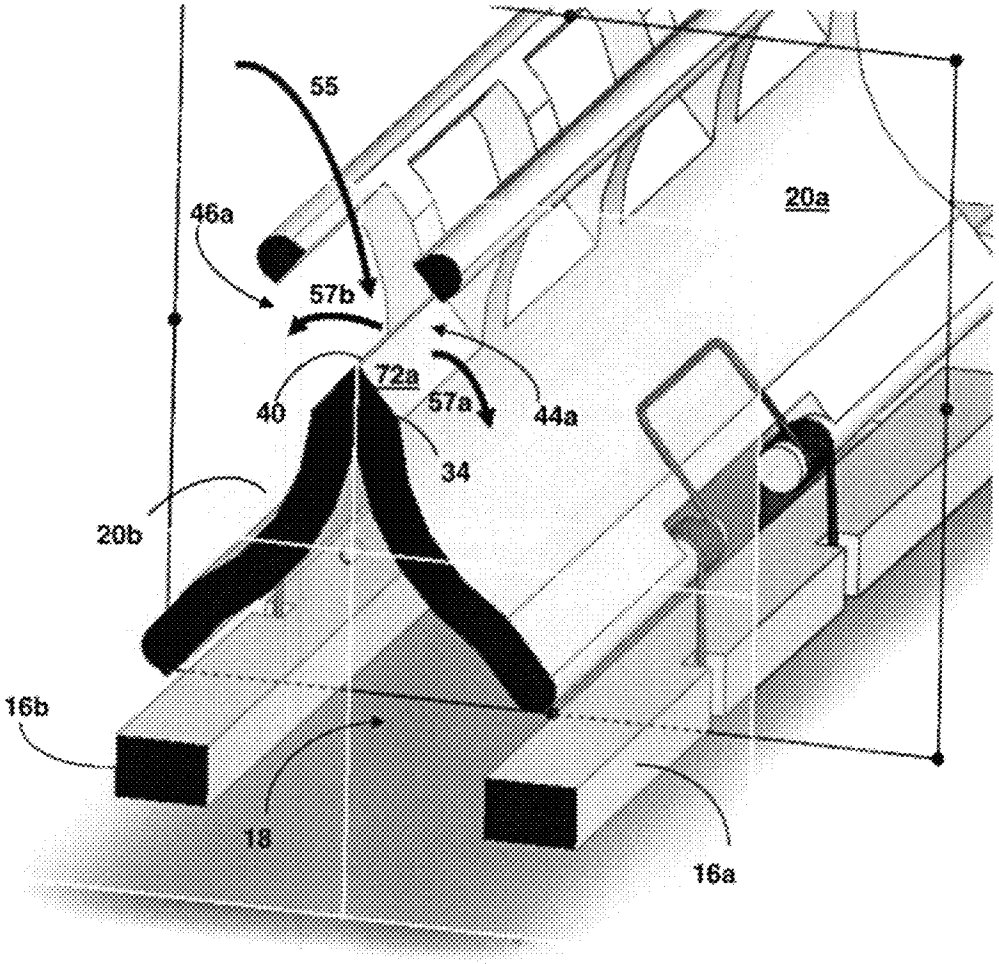
FIG. 3 is a perspective cross-sectional view of the housing system.

FIG. 3 is a cross-sectional perspective view of housing 10, taken along lines A-A of FIG. 2A. As shown in FIG. 3, when flaps 20*a* and 20*b* are in the "closed" position, such that they are both biased by their respective springs, 54 and 56, against their respective stops on side walls 14*a* and 14*b*, midpoints of each flap contact each other along a contact region 34 in a longitudinal plane of the housing 10. Apertures 44*a* and 46*a* are defined at a lower end by a bevels 72*a* in flap 20*a* and 72*b* in flap 20*b*. Bevels 72*a* and 72*b* of each aperture 44 and 46 meet to form a pointed edge 40 along flaps 20*a* and 20*b*. The sections of flaps 20*a* and 20*b* extending from edge 40 to upper portions 36*a* and 36*b* define an insertion region 52 there between.

Bevels 72*a* and 72*b*, as well as edge 40 are formed such that, when debris falls in to insertion region 52, as shown by arrow 55, the debris is deflected away from interior space 18, as shown by arrows 57*a* and 57*b*. As is described below, when a plug of a paddle card in inserted into insertion region 52 to open the housing 10, since any debris that has fallen into insertion region 52 has been deflected outside of the insertion region 52, no debris will fall into interior space 18 when the plug is inserted therein.

Figure 4:
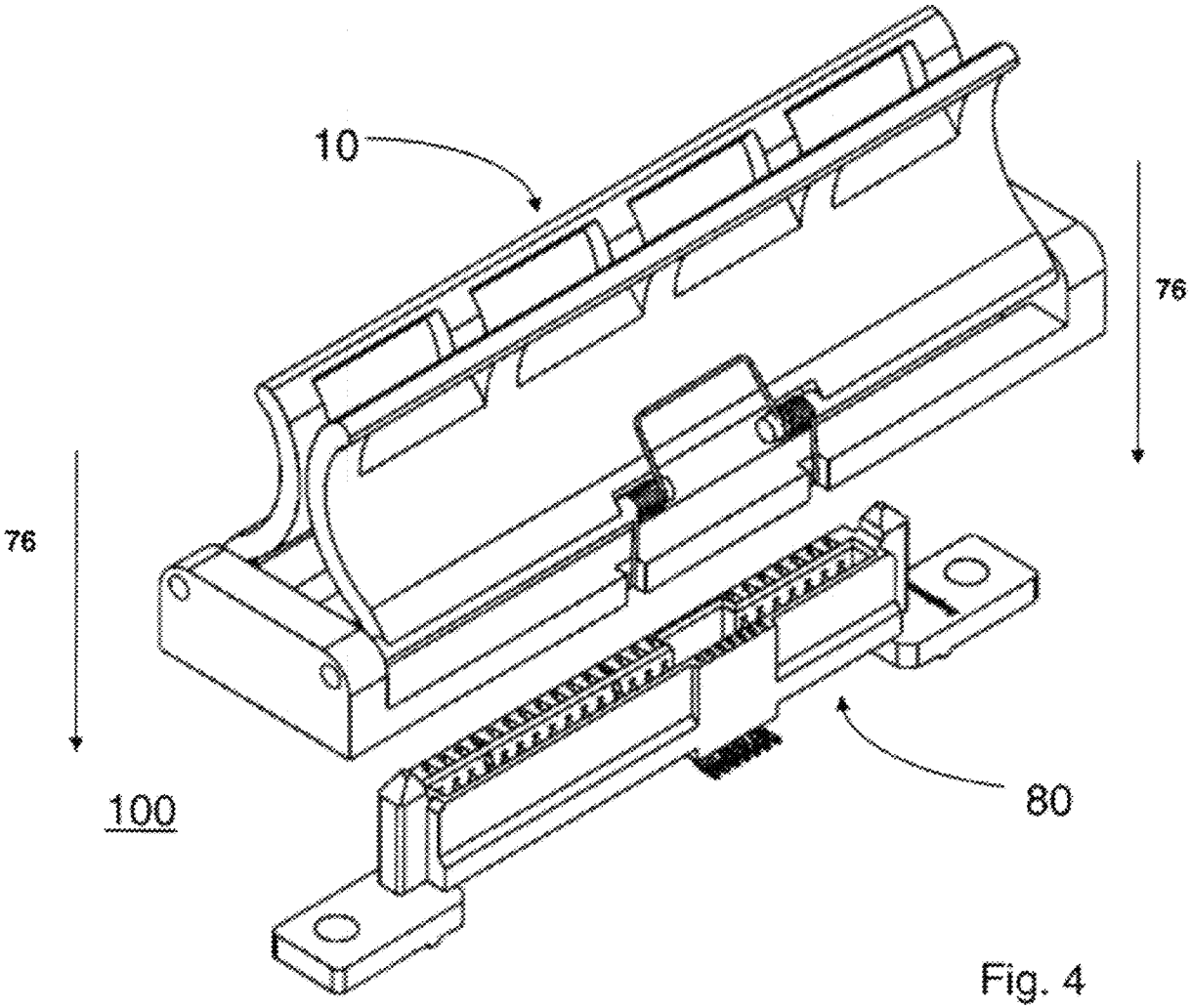
FIG. 4 is a perspective view showing the housing system according to the present invention and a connector over which the housing system is mounted.

FIG. 4 is an exploded perspective view of the housing 10 and a connector 80, which is mounted to a circuit board 100. In use, housing 10 is also mounted to circuit board 100, with connector 80 housed within interior space 18.

Figure 5:
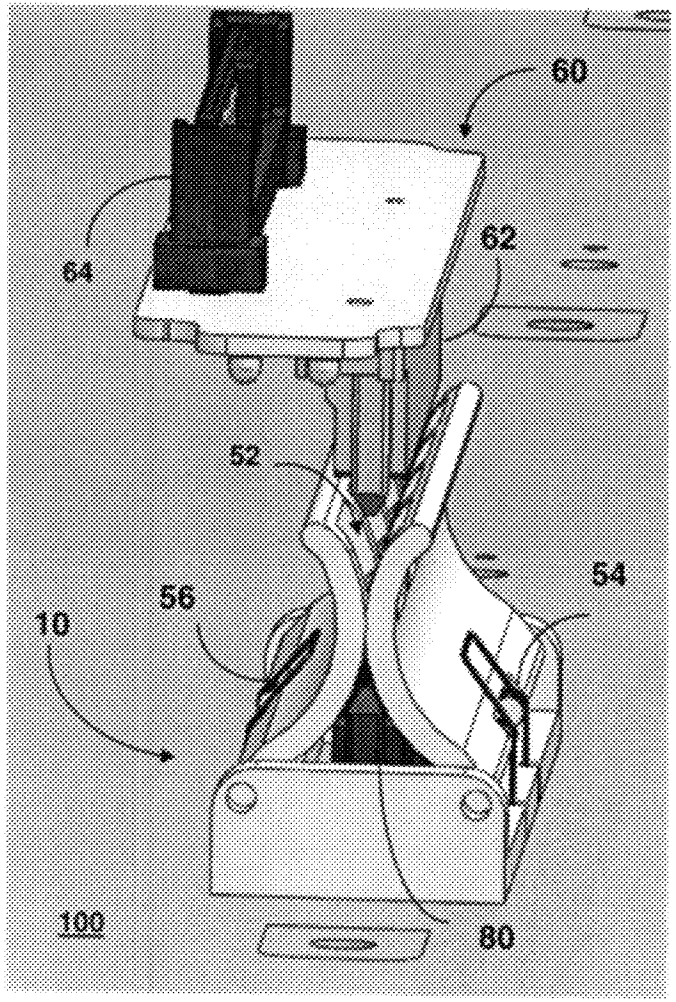
FIGS. 5-7 are perspective views showing a paddle card being inserted into the housing system and connected with the connector.
Figure 6:
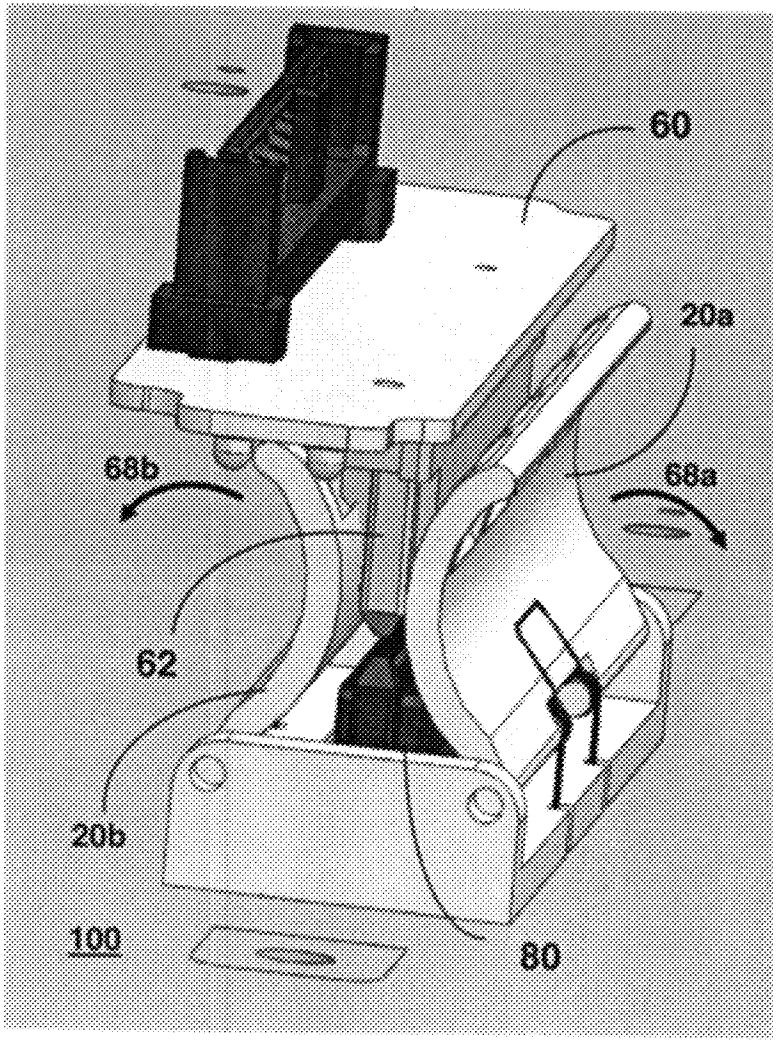
Figure 7:
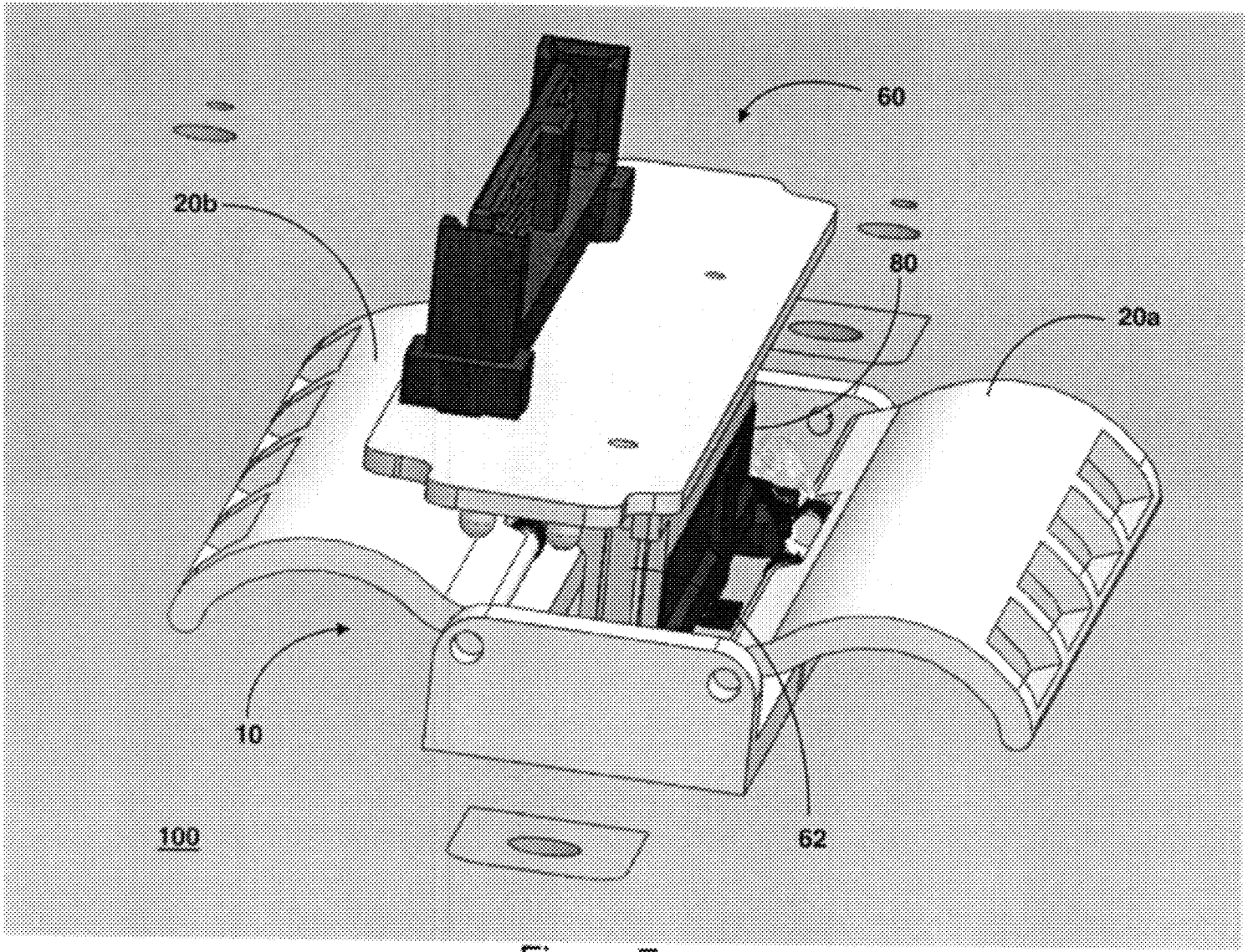

FIGS. 5-7 are perspective diagrams showing how a paddle card is inserted into the housing to connect a disk drive coupled to the paddle card to the connector in the interior space of the housing. Shown in FIG. 5 is a paddle card 60, which includes a plug 62 for connecting the paddle card to the connector 80, and a disk drive terminal 64 for connecting the paddle card to a disk drive (not shown). For simplicity, in FIGS. 5-7, the disk drive is not shown. It is, however, shown in FIGS. 8-10 below. Connector 80 is mounted to circuit board 100 within interior space 18 of housing 10, which is also mounted to circuit board 100.

As shown in FIG. 5, paddle card 62 is positioned above housing 10, with the leading end of plug 62 within insertion region 52. Flaps 20*a* and 20*b* are biased against one another by springs 54 and 56, respectively. In FIG. 5, housing 10 is in the "closed" position, preventing debris from falling into connector 80.

In FIG. 6, as plug 62 is pushed into housing 10, flaps 20*a* and 20*b* are pushed away from each other by plug 62, in the directions shown by arrows 68*a* and 68*b*. This enables plug 62 to enter interior space 18 of housing 10, for insertion into connector 80.

FIG. 7 shows plug 62 of paddle card 60 fully inserted into housing 10, with plug 62 mounted in connector 80. While flaps 20*a* and 20*b* are shown wide open, this is for illustrative purposes only to show the connection between plug 62 and connector 80 in interior space 18 of housing 10. It will be understood that flaps 20*a* and 20*b* would be biased against paddle card 60 by springs 54 and 56, respectively.

When the paddle card is disconnected from the connector 80 by removing the plug from the connector and the interior space 18, the flaps 20*a* and 20*b* are returned to the closed position by the force of springs 54 and 56.

Figure 8:
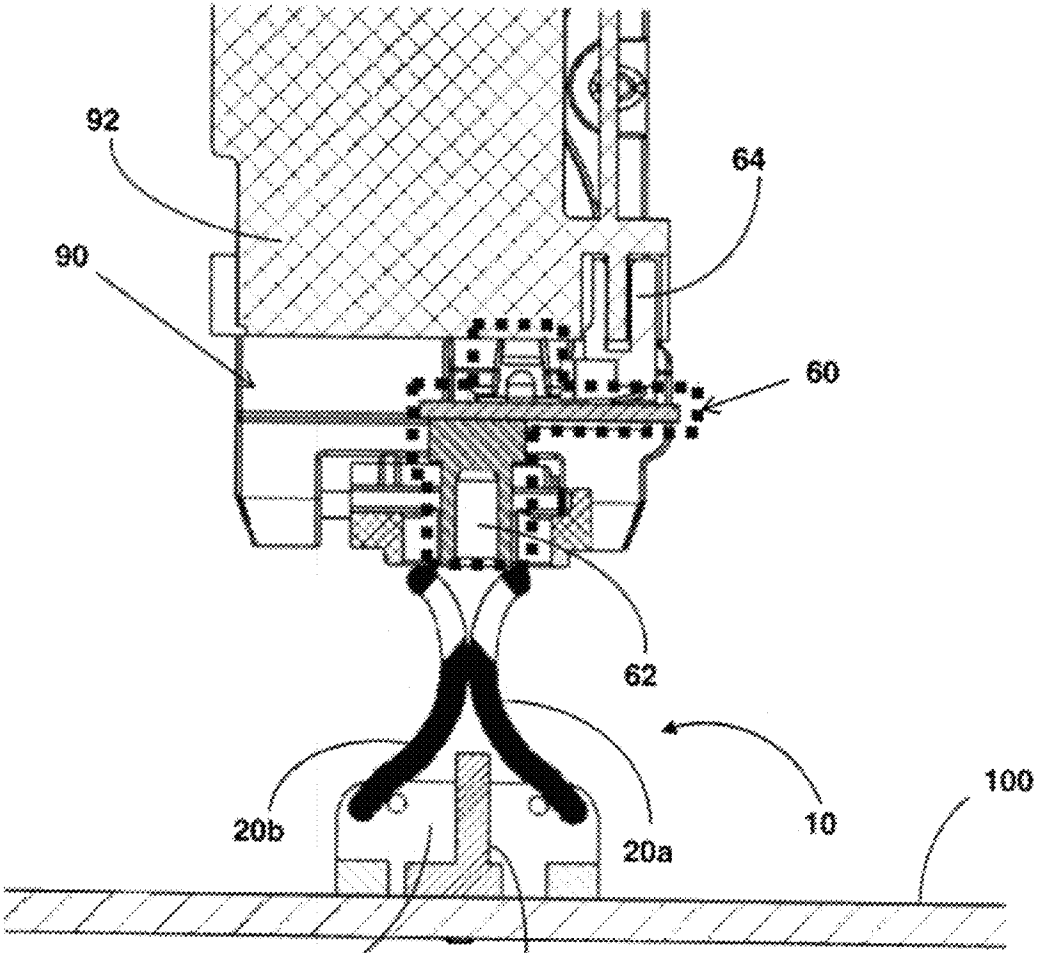
FIGS. 8-10 are perspective views showing a disk drive carrier mounted to a paddle card being inserted into the housing system and connected with the connector.
Figure 9:
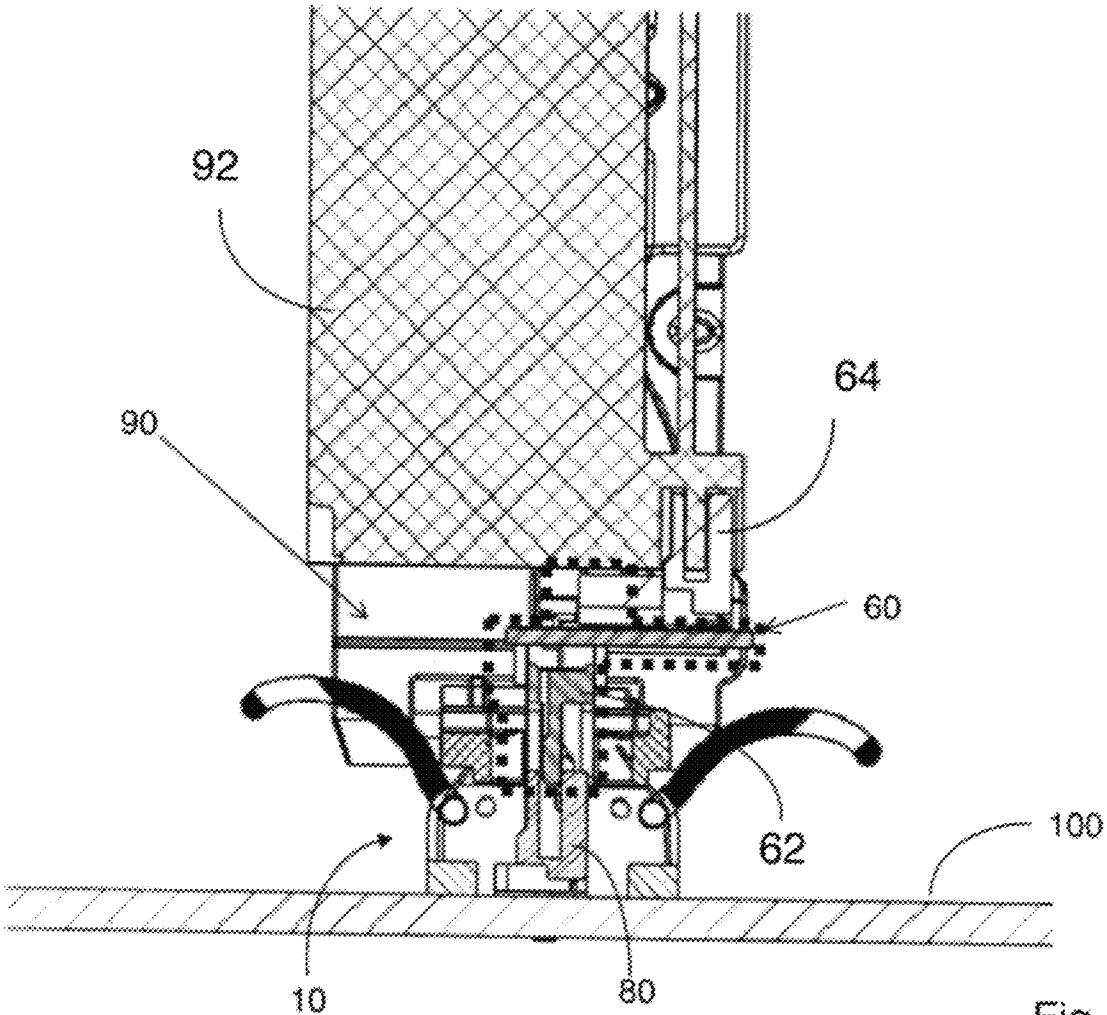
Figure 10:
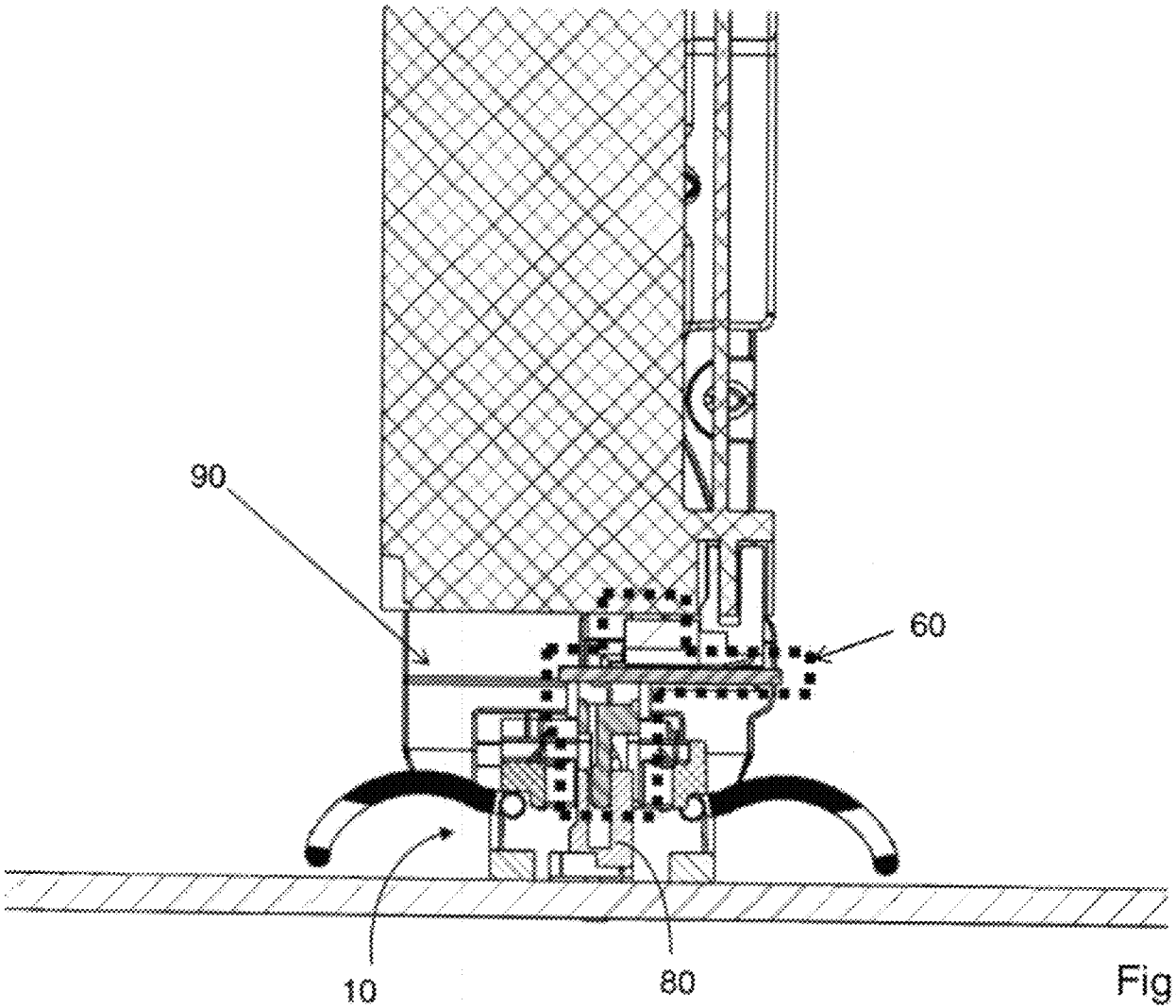

FIGS. 8-10 are cross-sectional views of a connector 80 mounted to a circuit board 100 within the interior space 18 of a housing 10. Paddle card 60, including plug 62, shown within dotted lines, is mounted to a disk drive carrier 90, via disk drive terminal 64. Disk drive carrier 90 includes a disk drive 92 mounted thereon. In FIG. 8, paddle card 62 is positioned above housing 10, with the leading end of plug 62 within insertion region 52. Flaps 20*a* and 20*b* are biased against one another by springs 54 and 56, respectively. In FIG. 8, housing 10 is in the "closed" position, preventing debris from falling into connector 80.

In FIG. 9, as plug 62 is pushed into housing 10, flaps 20*a* and 20*b* are pushed away from each other by plug 62 and disk drive carrier 90. This enables plug 62 to enter interior space 18 of housing 10, for insertion into connector 80.

FIG. 10 shows plug 62 of paddle card 60 fully inserted into housing 10, with plug 62 fully mounted in connector 80. FIG. 10 shows the housing 10 in the "open" position.

In an alternative embodiment, housing 10 may be constructed from a single component, wherein base portion 12 and flaps 20*a* and 20*b* are formed as a single piece. In such an embodiment, housing 10 would be formed of a flexible material such that flaps 20*a* and 20*b* are normally positioned in the closed position, but are able to flex at the connection points between flaps 20*a* and 20*b* and side walls 14*a* and 14*b* when the plug portion of the paddle card is inserted through the insertion region into the interior space. This embodiment would eliminate the need for the springs to bias the flaps in the closed position.

Accordingly, a housing for an electrical connector is disclosed which covers the connector when the connector is not in use, to protect it from debris that would otherwise fall into the connector. When the connector is to be connected to a paddle card, a portion of the paddle card is able to open the housing to enable access to the connector by the paddle card without any extra actions required to open the housing.

The system may be embodied in other specific forms without departing from the spirit or essential characteristics thereof. For example, while flaps 20*a* and 20*b* are shown as being curved and concave, they may be any shape that enables them to operate as described. Furthermore, although the system has been described in connection with a data storage system, it will be understood that the system may be sized and utilized for housing any type of electronic components in any type of electronic system. The present embodiments are therefore to be considered in respects as illustrative and not restrictive, the scope thereof being indicated by the appended claims rather than by the foregoing description, and all changes which come within the meaning and range of the equivalency of the claims are therefore intended to be embraced therein.

What is claimed is:

1. A housing system for covering a connector mounted on a board comprising: a base comprising first and second opposing walls connected by a first and a second longitudinal rail wherein the first and second opposing walls define an interior space there between, the connector being positioned within the interior space; first and second flaps, each having a proximal end, a distal end and an intermediate portion between the proximal and distal ends, each of the first and second flaps being mounted to the first and second opposing walls of the base, each of the first and second flaps each pivotally movable about a first hole and a second hole with each of the first and second opposing walls at the proximal end and the distal end of each of the first and second flaps, between a first position, in which the intermediate portion of the first flap is seated against the intermediate portion of the second flap, and a second position, in which the intermediate portions of the first and second flaps are apart from each other to enable access to said interior space by an object to be mounted in the connector; at least one of the first and second flaps having at least one aperture therein between the intermediate portion and the distal end thereof; and wherein, in the first position, the intermediate portions of each of the first and second flaps are a first distance from each other and the distal ends of the first and second flaps are a second distance from each other, the second distance being greater than the first distance.

2. The system of claim 1 further comprising means for biasing the first and second flaps in the first position.

3. The system of claim 2, wherein means for biasing includes a first biasing member mounted on the base rotatably holding the proximal end of the first flap in the base to bias the first flap in the first position covering the interior space and a second biasing member mounted on the base rotatably holding the proximal end of the second flap in the base to bias the second flap in the first position covering the interior space.

4. The system of claim 2, wherein the biasing means includes a spring disposed between the base and a proximal end of a flap.

5. The system of claim 2, wherein the biasing means includes a flexible material rotatably holding a flap in the base to bias the flap in the first position.

6. The system of claim 1, wherein the first flap has a plurality of apertures therein between the intermediate portion and the distal end thereof.

7. The system of claim 1, wherein the second flap has a plurality of apertures therein between the intermediate portion and the distal end thereof.

8. The system of claim 1, wherein an area between the intermediate portions of each of the first and second flaps and the distal ends of each of the first and second flaps defines an insertion region, the first and second flaps being deflected away from each other by contact from the object when the object enters through the insertion region into the interior space.

9. The system of claim 8, wherein debris entering the insertion region are directed through the at least one aperture of the at least one of the first and second flaps and outside of the insertion region, thereby preventing debris from entering into the interior area.

10. The system of claim 1, wherein the object includes an electronic device.

11. The system of claim 10, wherein the connector includes an electronic connector pin adapted to receive an electronic device.

12. The system of claim 10, wherein the object includes a plug for connecting an electronic device to the socket.

13. The system of claim 1, wherein the board includes a printed circuit board.

14. The system of claim 1, wherein the connector includes a socket.

15. The system of claim 1, wherein each of the first and second flaps is of curved shape.

16. A housing system for covering a connector mounted on a board comprising:

a base comprising first and second opposing walls connected by a first and a second longitudinal rail wherein the first and second opposing walls define an interior space there between, the connector being positioned within the interior space;

first and second flaps, each having a proximal end, a distal end and an intermediate portion between the proximal and distal ends, each of the first and second flaps being mounted to the first and second opposing walls of the base, each of the first and second flaps each pivotally movable about a first hole and a second hole with each of the first and second opposing walls at the proximal end and distal end of each of the first and second flaps, between a first position, in which the intermediate portion of the first flap is seated against the intermediate portion of the second flap, and a second position, in which the intermediate portions of the first and second flaps are apart from each other to enable access to said interior space by an object to be mounted in the connector; at least one of the first and second flaps having at least one aperture therein between the intermediate portion and the distal end thereof; wherein, in the first position, the intermediate portions of each of the first and second flaps are a first distance from each other and the distal ends of the first and second flaps are a second distance from each other, the second distance being greater than the first distance; and wherein, the housing system being constructed and arranged such that the first and second flaps are biased in the first position.

17. The system of claim 16, further comprising:

a first biasing member mounted on the base rotatably holding the proximal end of the first flap in the base to bias the first flap in the first position covering the interior space; and a second biasing member mounted on the base rotatably holding the proximal end of the second flap in the base to bias the second flap in the first position covering the interior space.

18. The system of claim 17, wherein each of the first and second biasing members includes a spring disposed between the base and the proximal end of each of the first and second flaps.

19. The system of claim 17, wherein each of the first and second biasing members includes a flexible material rotatably holding each of the first and second flaps in the base to bias each of the first and second flaps in the first position.

20. The system of claim 16, wherein an area between the intermediate portions of each of the first and second flaps and the distal ends of each of the first and second flaps defines an insertion region, the first and second flaps being deflected away from each other by contact from the object when the object enters through the insertion region into the interior space.

* * * * *